US005668356A

United States Patent [19]

Powell et al.

[11] Patent Number: 5,668,356

[45] Date of Patent: Sep. 16, 1997

[54] ELEVATOR DISPATCHING EMPLOYING HALL CALL ASSIGNMENTS BASED ON FUZZY RESPONSE TIME LOGIC

[75] Inventors: Bruce A. Powell, Canton; Jannah Stanley, Cromwell; David J. Sirag, Jr., South Windsor, all of Conn.

[73] Assignee: Otis Elevator Company, Farmington, Conn.

[21] Appl. No.: 696,442

[22] Filed: Aug. 13, 1996

Related U.S. Application Data

[63] Continuation of Ser. No. 264,652, Jun. 23, 1994, abandoned.

[51] Int. Cl.[6] ..... B66B 1/36

[52] U.S. Cl. ..... 187/382; 187/392; 187/387

[58] Field of Search ..... 187/392, 380, 187/382, 387, 381

[56] References Cited

U.S. PATENT DOCUMENTS

| | | | |
|---|---|---|---|
| 4,760,896 | 8/1988 | Yamaguchi | 187/124 |
| 4,793,443 | 12/1988 | MacDonald et al. | 187/127 |
| 5,020,642 | 6/1991 | Tsuji | 187/124 |
| 5,022,498 | 6/1991 | Sasaki et al. | 187/127 |
| 5,024,295 | 6/1991 | Thangavelu | 187/125 |
| 5,146,053 | 9/1992 | Powell et al. | 187/127 |
| 5,260,526 | 11/1993 | Sirag, Jr. | 187/127 |
| 5,427,206 | 6/1995 | Powell et al. | 187/387 |
| 5,467,844 | 11/1995 | Powell et al. | 187/387 |
| 5,563,386 | 10/1996 | Powell et al. | 187/382 |

FOREIGN PATENT DOCUMENTS

| | | | |
|---|---|---|---|
| 1203187 | 8/1989 | Japan | B66B 1/18 |
| 2215488 | 9/1989 | United Kingdom | B66B 1/20 |
| 2245998 | 1/1992 | United Kingdom | B66B 1/20 |

OTHER PUBLICATIONS

Copy of EPC Search Report Serial No. 95304374.2 dated Oct. 30, 1995.

Copy of Singapore Search Report Serial No. 9500709-2 dated Mar. 27, 1996.

*Primary Examiner*—Robert Nappi

[57] ABSTRACT

Each car in a group of elevator cars in a building is determined to be available or not depending on whether it is assigned in the group, whether it is the only delayed car, whether it is fully loaded without intervening car calls which comprise all the car calls, whether it has intervening hall calls, and whether other cars in the group are fully loaded with or without some chance of offloading passengers before reaching a call to be assigned. Among available cars, assignment is made based on each car's membership in fuzzy sets relating to low, medium or high delay in that car responding to the call and each car's membership in fuzzy sets indicative of the extent to which assignment of that car will have no adverse effect or a very high adverse effect on the response to already-assigned hall calls. The call is assigned to the car with the highest summation of weighted memberships in the fuzzy sets.

11 Claims, 3 Drawing Sheets

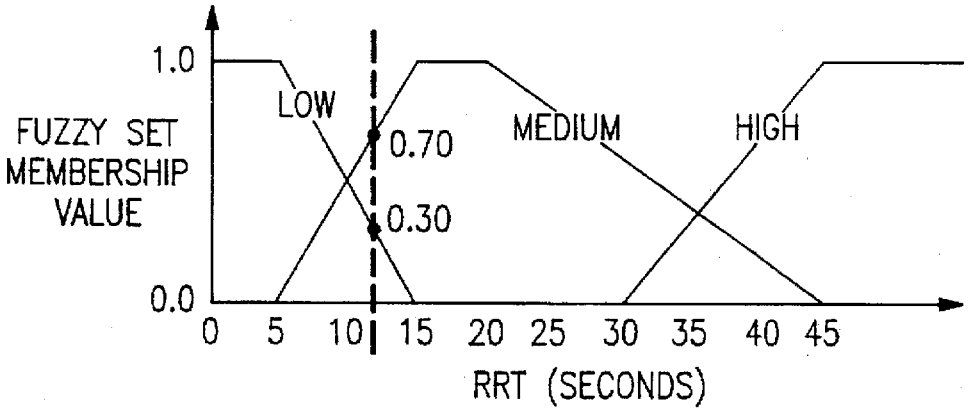
FIG.3
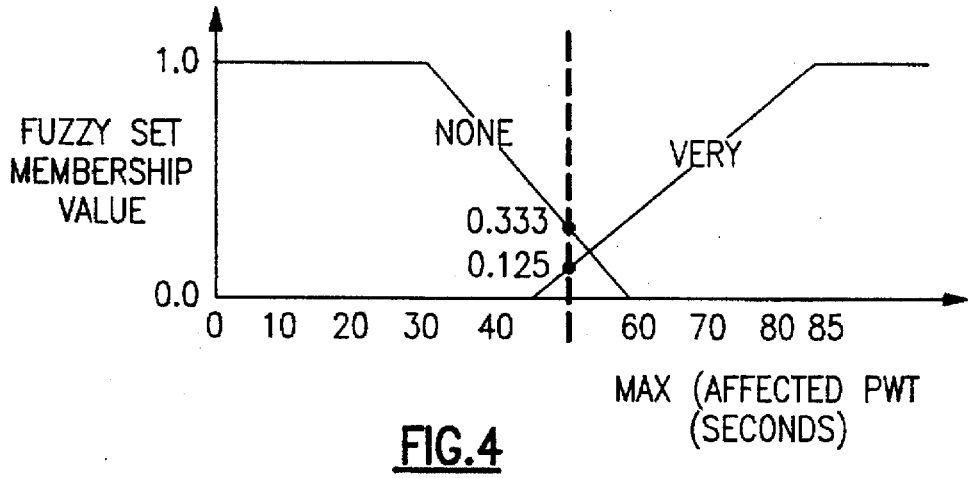
FIG.4
| | | AFFECTED-ELDERLY-CALL | |
|---|---|---|---|
| | | NONE | VERY |
| RRT | LOW | 100 | 25 |
| | MEDIUM | 75 | 10 |
| | HIGH | 15 | 5 |
FIG.5

ELEVATOR DISPATCHING EMPLOYING HALL CALL ASSIGNMENTS BASED ON FUZZY RESPONSE TIME LOGIC

This is a continuation of application Ser. No. 08/264,652, filed Jun. 23, 1994, now abandoned.

TECHNICAL FIELD

This invention relates to dispatching elevator cars to respond to hall calls assigned thereto by a process involving fuzzy logic expressions of expected time for each car to respond to a call and the effect of such assignment on the response of cars to other calls.

BACKGROUND ART

The assignment of elevator car calls as soon as they are registered, so as to permit persons to queue in front of the hoistway door of the car which is expected to answer the call, and to provide reassurance to passengers, is typically made in response to predictions. In commonly owned copending U.S. patent application Ser. No. 07/812,189, filed Dec. 20, 1991, assignment of hall calls is based upon the car which is predicted to get there most quickly, unless it causes other calls to become "elderly" (or more so); the term "elderly" meaning that it has been predicted that the call would not be answered in a minute or less. The problem with the system of the aforementioned application is that even though a car could answer the call in question extremely quickly (for instance, in less than 10 seconds), if such assignment would cause the predicted response to any other call to advance from 59 to 60 seconds, or from 61 to 62 seconds, thereby either causing it to become elderly or more elderly, that car would not get the assignment; this is true even if all of the remaining assignments might take 40 or more seconds and would cause calls to have to wait 57 or 59 seconds. In such a circumstance, obviously the first car would be a better assignment than any of the others, but such an assignment would not be made. On the other hand, if thresholds are not used, then the fear of every building owner could occur, by allowing excessively long response time for some of the calls in order to permit excessively fast response time to others of the calls. Frequently, elevator performance requirements which are guaranteed by contract include that there be no more than a few (one or two) calls which take excessively long to be answered (a minute or so) in any given interval of time (such as one hour) during business hours. Therefore, thresholds have to be used, and the aforementioned results cannot be avoided.

DISCLOSURE OF INVENTION

Objects of the invention include elevator car dispatching employing hall call assignments which are reasonable both in terms of the predicted length of time to answer the call being assigned and the impact of such an assignment upon the predicted length of time to answer all of the other assigned hall calls in the building, and a hall call assignment system which can easily be tailored to suit the desired response characteristics of a given group of elevators, in terms of both the nature of traffic therein and the required passenger satisfaction.

According to the present invention, the predicted time for a car to respond to a potentially assigned hall call is converted into memberships in a plurality of fuzzy sets indicative of varying degrees of delay, and the predicted impact on all other assigned hall calls, if excessive, is also assigned membership in a plurality of fuzzy sets, each indicative of the degree to which the other calls are adversely affected, and the results are given suitable emphasis to permit selecting the best overall predicted response to determine the assignment.

According to the invention, the emphasis is effected by weighted combinations of car response time and affect on other calls; in one embodiment, this is achieved by the summation of products.

According to the invention still further, dispatching is improved by considering a car available to service hall calls unless it is delayed when other cars are not, or if it is fully loaded and has no opportunity to offload some passengers before reaching the call in question, unless other cars are not fully loaded, or should become not fully loaded before reaching the call in question.

The invention makes it possible to balance the predicted time to respond to the call in question with the predicted impact that such an assignment would have on the other calls. The invention is easily implemented utilizing apparatus and technology which are well within the skill of the art, in the light of the teachings which follow hereinafter.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 3 is a chart illustrating a plurality of fuzzy sets having degrees indicative of delay involved in the predicted response of an elevator to a call.

FIG. 4 is a diagram illustrating a plurality of fuzzy sets having degrees indicative of the extent to which assignment of a call to car will adversely affect the predicted waiting time of other assigned hall calls.

FIG. 5 is a table indicating exemplary emphasis weighting.

BEST MODE FOR CARRYING OUT THE INVENTION

Figure 1:
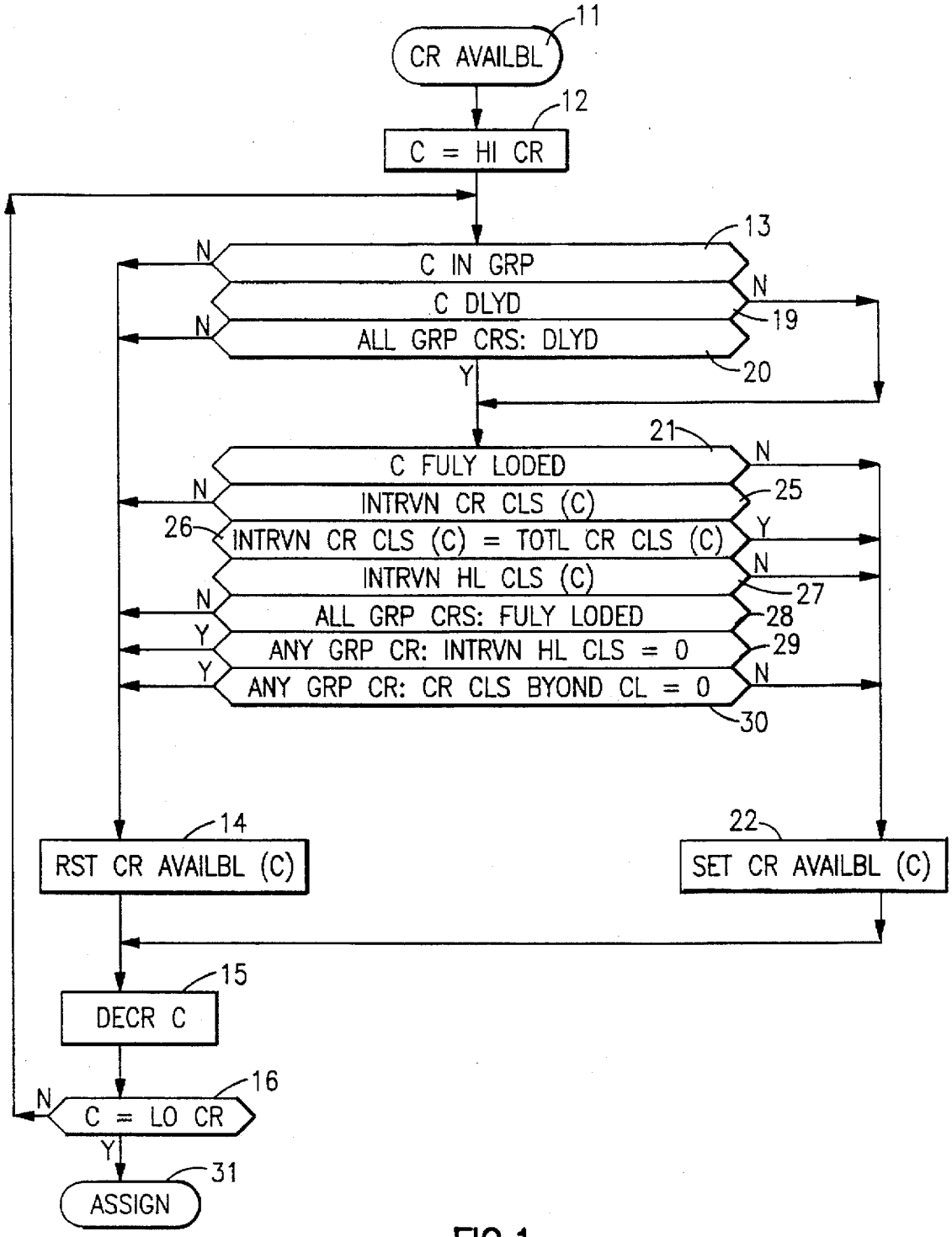
FIG. 1 is a logic flow diagram of a car available routine according to the invention.

Referring now to FIG. 1, a car available routine may be part of an overall assignor routine of a type well known in the art in which hall calls are assigned in sequence, such as by first assigning calls in the up direction, floor by floor, and then assigning calls in the down direction, floor by floor. For each direction and floor, if there is hall call, each available car is given consideration for answering the call and then all of the cars are considered in determining to which car the call will be assigned. Within that structure, the car available routine of FIG. 1, followed by the assignment routine of FIG. 2, are reached for each call in turn.

In FIG. 1, the car available routine is reached through an entry point 11 and a first step 12 sets a car counter, C, to the number of the highest numbered car in the group. This counter keeps track of each car as each car is considered for assignment of the call. Then a test 13 determines if car C is in the group, or not. If not, a negative result of test 13 reaches a step 14 which resets the bit representing car C in a map of available cars. Then, a step 15 decrements the C counter and a test 16 determines if all the cars have been examined yet, or not. If not, the routine reverts to test 13 to see if the next lower car in turn is in the group. Assuming that it is, a test 19 determines if car C is delayed by virtue of its doors not closing, for some reason or another. If the car is delayed, a test 20 determines if all other cars in the group are also delayed. If the car is delayed and other cars are not delayed, a negative result of test 20 will reach the step 14 to cause this car to become unavailable. But if the car is not delayed or all cars are delayed, a test 21 determines if this car is fully loaded, as indicated by load weighing or other well known car load measurement devices. If not, a negative result of test 21 reaches a step 22 where the map of available cars has the bit set to indicate that car C is among the available cars. And then the step and test 15, 16 are reached so the program will again revert to the test 13.

On the other hand, if car C is fully loaded, an affirmative result of test 21 reaches a test 25 to determine if there are intervening car calls; that is, calls registered within car C for floors between the present position of car C and the call being considered for assignment. If there are intervening car calls, this means that passengers will get off and that, therefore, there should be some room for passengers by the time the car reaches the call in question. If there are no intervening car calls, this indicates that the car will remain fully loaded, and a negative result of test 25 will reach the step 14 to cause the car to be registered as unavailable. If there are intervening calls, an affirmative result of test 25 reaches a test 26 to determine if all of the car calls are intervening. If they are, this assures that there will be room in the car by the time it reaches the call, so an affirmative result of test 26 reaches the step 22 to register the car as available. If all the calls are not intervening, a negative result of test 26 reaches a test 27 to see if there are any intervening hall calls. If there are no intervening hall calls, then there is little likelihood that more passengers will enter the car to replace the passengers that will likely get off on the intervening car calls determined in test 25. Therefore, a negative result of test 27 will similarly reach the step 22. But if there are intervening hall calls, an affirmative result of test 27 reaches a test 28 to determine if all of the cars in the group are fully loaded. If they are not, there is no point in overloading this car, so a negative result of test 28 reaches the step 14 to register this car as being unavailable. If all of the cars are fully loaded, an affirmative result of test 28 reaches a test 29 to determine if there is any car in the group which has no intervening hall calls between its present position and the position of the call in question. If there is such a car, it may be able to handle the call, so an affirmative result of test 29 will reach the step 14 to register the current car as unavailable. If there is no car in the group that has no hall calls between its present position and the hall call in question, a negative result of test 29 reaches a test 30 to determine if any car in the group has no car calls beyond the call in question, indicating some sort of possibility that, even though all cars are fully loaded, some car may have room because all of its calls (relating to any load it presently may have) are intervening. Thus, the tests 28–30 determine either that there is room, there may get to be room, or there should be room by the time some other car reaches the call, so that this fully loaded car should not be considered as available. But if this car is fully loaded, and all the other cars are fully loaded and do not look as if they could or should acquire room for more passengers, then this car is no worse than the rest and so a negative result of test 30 will reach the step 22 to register this car as available to answer the call. Eventually, after decrementing the C counter in step 15, it will represent the low car so an affirmative result of test 16 will advance the programming through a transfer point 31 to the assignment routine of FIG. 2.

Figure 2:
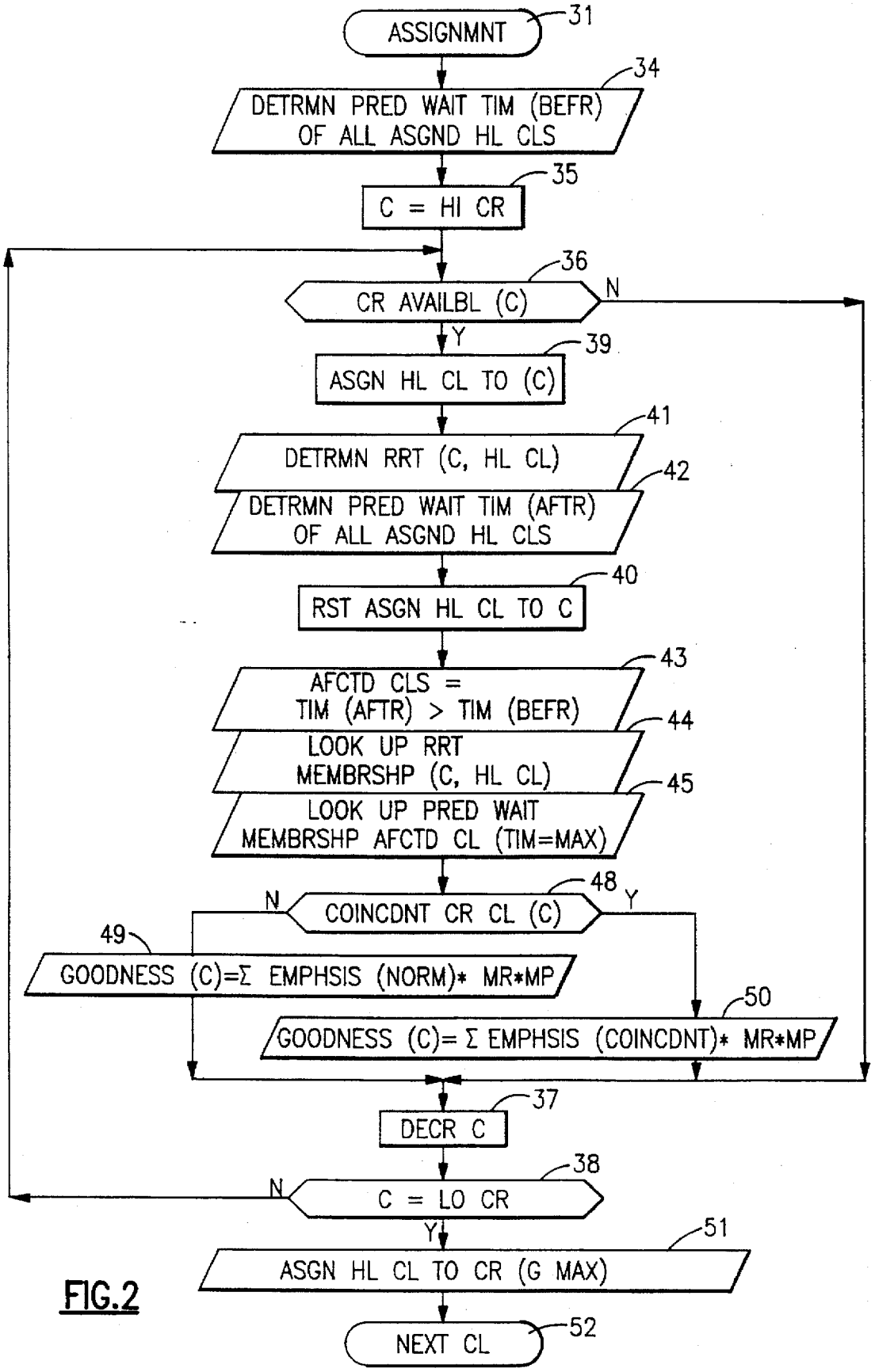
FIG. 2 is a logic flow diagram of an assignment routine in accordance with the invention.

In FIG. 2, a first subroutine 34 determines the predicted waiting time for all hall calls, not including the hall call under consideration (which remains unassigned at this time); this is referred to herein as predicted waiting time "before" the assignment. The predicted waiting time is the time that the call has been outstanding plus the remaining response time (RRT) which it is predicted will be required for the car currently assigned to answer each call to reach such call. Then, a step 35 once again sets the C counter to the high car. Then, a test 36 checks whether the car is available, as determined in steps 14 and 22 of FIG. 1. If not, a step 37 will decrement the C counter and a test 38 determines if all cars have been processed yet, or not. If not, the program reverts to the test 36 for the next lower car in sequence. If the car is available, a step 39 will assign the hall call in question to the car (C) under consideration. This assignment is temporary and is automatically undone in every instance, at step 40, as described hereinafter. A subroutine 41 determines the predicted remaining response time of car C to reach this hall call, in accordance with well known principles, some of which are described in the aforementioned copending application. Basically, it simply is estimates of time it takes for the car to traverse distances, open and close doors, allow passengers to enter and exit the car, and so forth, in the light of the already assigned hall calls and registered car calls. A subroutine 42 determines the predicted waiting time which all of the other assigned hall calls would endure in the event that this call were assigned to the car in question; this is referred to herein as predicted waiting time "after" the assignment. Then step 40 un-assigns the call from car C. A subroutine 43 determines all of the "affected" calls, which are defined as those for which the predicted waiting time after the assignment (determined in subroutine 42) exceeds the predicted waiting time before the assignment (as determined in the subroutine 34). All of the calls which are affected (in the sense that, should this assignment be made, their predicted waiting time will be longer than if this assignment is not made) are given consideration, whether or not such calls are predicted to wait in excess of some threshold value. As will be seen, this is accommodated in the fuzzy logic and emphasis of the present invention.

Once the estimated remaining response time for this car to answer the subject hall call and the adverse affect on all the rest of the calls are known, the membership of the remaining response time for this car to answer the subject hall call is looked up in the subroutine 44 in each of a plurality of fuzzy sets, the degree of which are remaining response time, such as the fuzzy sets illustrated in FIG. 3. And then the membership of the one of the affected calls having the maximum predicted waiting time has its membership value looked up in the subroutine 45 in a plurality of fuzzy sets having degree of predicted waiting time, such as the fuzzy sets illustrated in FIG. 4. The fuzzy sets each represent a different degree of unsuitability of this car to service this call. The fuzzy sets of FIGS. 3 and 4 can be expressed in standard format as follows:

RRT is LOW={[1.0,0], [1.0,5], [0.0,15]}

RRT is MEDIUM={[0.0,0], [0.0,5], [1.0,15], [1.0,20], [0.0,45]}

RRT is HIGH={[0.0,0], [0.0,30], [1.0,45]}

AFFECTED-ELDERLY-CALL is NONE={[1.0,0], [1.0,30], [0.0, 60]}

AFFECTED-ELDERLY-CALL is VERY={[0.0,0], [0.0,45], [1.0, 85]}

The effect that the membership values in the five fuzzy sets of FIGS. 3 and 4 (provided by subroutines 44 and 45) should have is determined by giving emphasis to the various combinations of remaining response time and affected predicted waiting time according to a table, such as the table shown in FIG. 5. The sample values shown in the table of FIG. 5 indicate an obvious truth: that a low value of remaining response time and no affected elderly calls is much preferred to anything else, and a high response time and a very pronounced effect on other calls is least preferred.

The process of evaluating the fuzzy rule set that results from combining the membership values determined in subroutines 44 and 45 with the emphases of FIG. 5 can be achieved, in a standard fashion, by utilizing multiplication for the T-Norm function (used to combine terms within a rule) and addition for the S-Norm function (used to combine the results of different rules). This fuzzy inference process can be written as a function which uses * for multiplication and + for addition to compute the overall Goodness for each car as shown Goodness (Car *C*) = (EQN 1)
emphasis (RRT is LOW and AFFECTED-ELDERLY-CALL is NONE) *
membership (RRT is LOW) * membership (AFFECTED-ELDERLY-CALL is NONE) +
emphasis (RRT is MEDIUM and AFFECTED-EDERLY-CALL is NONE) *
membership (RRT is MEDIUM) * membership (AFFECTED-ELDERLY-CALL is NONE) +
emphasis (RRT is HIGH and AFFECTED-ELDERLY-CALL is NONE) *
membership (RRT is HIGH) * membership (AFFECTED-ELDERLY-CALL is NONE) +
emphasis (RRT is LOW and AFFECTED-ELDERLY-CALL is VERY) *
membership (RRT is LOW) * membership (AFFECTED-ELDERLY-CALL is VERY) +
emphasis (RRT is MEDIUM and AFFECTED-ELDERLY-CALL is VERY) *
membership (RRT is MEDIUM) * membership (AFFECTED-ELDERLY-CALL is VERY) +
emphasis (RRT is HIGH and AFFECTED-ELDERLY-CALL is VERY) *
membership (RRT is HIGH) * membership (AFFECTED-ELDERLY-CALL is VERY)

The Goodness (G) function can be written out in shorter notation using E for emphasis, m( ) for membership, L/N for low and none, and so forth, to express all six terms, as follows:

$$G(C) = E(L/N) * m(L) * m(N) + E(M/N) * m(M) * m(N) + E(H/N) * m(H) * m(N) + E(L/V) * m(L) * m(V) + E(M/V) * m(M) * m(V) + L(H/V) * m(H) * m(V) \quad \text{(EQN 2)}$$

For the example of FIGS. 3–5:

$$G(C) = 100 * .30 * .333 + 75 * .70 * .333 + 15 * .00 * .333 + 25 * .30 * .125 + 10 * .70 * .125 + 5 * .00 * .125 \quad \text{(EQN 3)}$$

$$G(C) = 9.99 + 17.50 + 0.00 + 0.94 + 0.88 + 0.00 \quad \text{(EQN 4)}$$

$$G(C) = 29.31 \quad \text{(EQN 5)}$$

In FIG. 2, a test 48 determines if the car under consideration has a car call coincident with the hall call to be assigned. If not, a negative result of test 48 reaches a subroutine 49 which calculates goodness of the assignment of this call to car C in the manner described hereinbefore with respect to Equations 1–5. This might, for instance, use the emphasis values set forth in FIG. 5 and Equation 3. On the other hand, if there is a coincident car call, then an affirmative result of test 48 reaches a subroutine 50 to perform the goodness evaluation of Equations 1–5 using a different set of emphasis factors which take into account the desirability of assigning a hall call to a car that is headed for that floor anyway. This typically would be done by increasing the values in the "VERY" column of FIG. 5, since coincident call is an overall system factor, as is the effect on other hall calls. Thus, the "VERY" column might be altered to 45, 20 and 15 in the case of a coincident car call. All of these factors are, of course, subject to tailoring to suit the particular need in any implementation of the present invention.

Once the goodness value of assigning this call to car C has been determined in either of the subroutines 49, 50 the step 37 is reached to decrement the C counter and the test 38 determines whether all of the cars have been examined to either determine that a car is not available, or determine its goodness value. Initially, they will not have, so a negative result of test 38 causes the program to revert to test 36; eventually, all of the cars in the group will have been handled, and the results of subroutines 49 and 50 can be considered to be a fuzzy set (ASSIGNMENT) of the form:

{[Goodness(Car1),Car1], [Goodness(Car2),Car2], . . . , [Goodness-(CarN),CarN]} (EQN 6)

To determine the actual assignment, the ASSIGNMENT fuzzy set is defuzzified by Max Defuzzification. This is the equivalent to selecting the car with the highest Goodness value (Equation 5). Therefore, an affirmative result of test 38 reaches a subroutine 51 in which the hall call is assigned to the car which has the maximum goodness value of all of those determined in either subroutine 49 or 50. Then, a transfer point 52 causes the program to revert to establish setting up the assignment for the next call in turn, until all of the hall calls have been evaluated. These assignments are reflected in the dispatching by the group controller, in a manner that the car controllers will ultimately cause the cars to serve the calls.

By inspection, it should be obvious that the routines of FIGS. 1 and 2 could be combined, in that the availability of each car could be determined as in FIG. 1 and then if available, its goodness value determined as in FIG. 2 before decrementing the C counter to identify the next car in turn. However, FIG. 1 and FIG. 2 have been shown as they are for the purpose of clarifying that the availability is distinct from the hall call assignment. These and other details in the manner in which the routines are actually carried out can be made in accordance with a wide variety of options known to those skilled in the art, without in any way changing the invention. Additionally, rather than having only two fuzzy sets related to affected predicted waiting time, as in FIG. 4 and the examples of Equations 1–5, it might more properly suit the utilization of this invention to have three or five different fuzzy sets which then could be applied in a way which is obvious in view of Equations 1–5. Similarly, other fuzzy sets and other values for the fuzzy sets could be chosen to suit any use of the present invention, all of which is immaterial to the practice of the invention, though such selections can greatly affect the value of the invention in any particular utilization thereof. In other words, the nature and number of fuzzy sets should be selected so as to achieve the best balance of response in economics that is desired in any given elevator group in which the invention is used. This is a feature of the invention.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A method of dispatching a plurality of elevators operating as a group in a building, including assigning hall calls to cars for service, comprising:

providing, for each hall call which is already assigned to be serviced by a car, a first predicted waiting time signal indicative of the predicted time before said already-assigned call will be serviced by the assigned car if no other hall calls are assigned to such car;

for each unassigned hall call that is to be assigned, providing for each car available to service said unassigned hall call, a remaining response time signal indicative of the estimated time it will take for said car to reach said call, and a plurality of second predicted waiting time signals, one for each of said already-assigned hall calls, each indicative of the predicted time that it will take for the corresponding already-assigned hall call to be serviced if said unassigned hall call is assigned to said car;

identifying as an affected predicted waiting time signal, each of said second predicted waiting time signals which is greater than the corresponding first predicted waiting time signal for the same already-assigned hall call;

providing a predetermined group of first fuzzy sets, each of said first fuzzy sets relating to the degree to which assignment of a hall call to a car will have an adverse affect on the predicted waiting time of all of said already assigned hall calls, each fuzzy set including a plurality of predetermined first sets of signals, each of said first sets of signals relating to a given predicted waiting time for said already-assigned hall calls, each of said first sets of signals having signals corresponding to a plurality of terms, each term including a basis element equaling a given predicted waiting time and a corresponding membership value indicative of the likelihood that assignment of a hall call to a car will adversely affect the predicted waiting time of said already assigned hall calls to the degree represented by the corresponding fuzzy set;

providing a predetermined group of second fuzzy sets, each of said second fuzzy sets relating to the degree to which the remaining response time for a car to answer a hall call constitutes an extensive period of time in responding to hall calls, each fuzzy set including a plurality of predetermined second sets of signals, each of said second sets of signals relating to a length of time for response to a hall call, each of said second sets of signals having signals corresponding to a plurality of second terms, each of said second terms including a basis element equaling a length of time for responding to a hall call and a corresponding degree of membership related to the likelihood that said length of time constitutes a degree of delay represented by the corresponding fuzzy set;

providing, from said first fuzzy sets, for the one of said affected predicted waiting time signals having the maximum second predicted waiting time, a plurality of signals indicative of an affected predicted waiting time fuzzy set in which each term has a basis element indicative of the degree to which said second predicted waiting time is determined to have an adverse effect on said already assigned hall calls and a degree of membership equal to the degree of membership of the related first fuzzy set;

providing, from said second fuzzy set, for each of said remaining response time signals, a plurality of signals indicative of a remaining response time fuzzy set in which each term has a basis element equaling the degree to which said response time is deemed to be an extensive period of time and a degree of membership equal to the degree of membership of the related second fuzzy set;

assigning said hall call based on said affected predicted waiting time fuzzy set and said remaining response time fuzzy set; and dispatching said cars to answer assigned hall calls.

2. A method according to claim 1 including:

providing a predetermined set of emphasis signals, each representing a value indicative of the degree to which a corresponding combination of the condition represented by each of said first fuzzy sets with each of said second fuzzy sets is deemed important in assigning cars to respond to hall calls; and assigning said hall call based on the summation, for each car, of the products of said membership values and the corresponding ones, respectively, of said emphasis signals.

3. A method according to claim 2 wherein said call is assigned to the car with the highest summation.

4. A method according to claim 1 wherein there is provided substitute ones of said first and second sets of signals for use with respect to any car which has a car call registered for the direction and floor of the hall call being assigned.

5. A method of dispatching a group of elevator cars to service registered hall calls, comprising, for each hall call to be assigned:

for each one of said cars that is a candidate to respond to an unassigned hall call, providing a signal indicative of a term in each one of a plurality of first sets of criteria signals, each of said first sets corresponding to a first hall call assignment criteria, each of said first sets corresponding to a different degree of said first assignment criteria, each term of said first sets having a value indicative of the extent to which the assignment of said one car to said call has the degree of conformance to said first assignment criteria indicated by the corresponding first set;

for each of said cars that is a candidate to respond to said hall call, providing a signal indicative of a term in each one of a plurality of second sets of criteria signals, each of said second sets corresponding to a second hall call assignment criteria, each of said second sets corresponding to a different degree of said second assignment criteria, each term of said second set having a value indicative of the extent to which the assignment of said one car to said call has the degree of conformance to said second assignment criteria indicated by the corresponding second set;

providing a predetermined set of emphasis signals, each emphasis signal corresponding to the combination of one of said first sets with one of said second sets;

providing a plurality of weighted signals, each weighted signal comprising the product of one of said emphasis signals and a term from each of said sets corresponding to said one emphasis signal;

providing, for each of said cars, the summation of said weighted signals; and dispatching said cars in said building in a process that includes assigning the one of said cars having the largest value of said summation signal to respond to said hall call.

6. A method according to claim 5 including:

providing for each one of said cars which has a coincident car call registered for the direction and floor of said hall call, substitute sets of criteria signals having values respectively corresponding to but different from said first and second sets; and assigning said hall call based on terms of said substitute sets for said cars having coincident car calls and based on said first and second sets for other ones of said cars.

7. A method of dispatching a group of elevator cars in a building including assigning hall calls to available elevator cars for service thereto, comprising, for each specific hall call to be assigned:

determining if a given car is fully loaded, and if it is not, providing an available signal indicative of the fact that said given car is available to answer hall calls, but if it is fully loaded, determining whether said given car has registered any intervening car calls between the present position of said given car and said specific hall call, and if it has not, providing an unavailable signal indicative of said given car being unavailable to service hall calls;

characterized by the improvement comprising:

if the car is fully loaded and there are car calls which are not intervening car calls, determining if there are any intervening hall calls between the present position of said given car and said specific hall call, and if there are not, providing said available signal, but if there are intervening hall calls, providing said available signal unless another car in said group either has room for passengers, or may have room for passengers by the time it reaches said specific call;

assigning hall calls to cars related to said available signals; and dispatching said cars to answer assigned hall calls.

8. A method according to claim 7 wherein said last step if there are intervening hall calls further comprises:

determining if all of the cars in the group are fully loaded, and if not, providing said unavailable signal, but if all of the cars in the group are fully loaded, determining if any other car in the group has no such intervening hall calls between the present position of such other car and said specific hall call, and if any other car in the group has no such intervening hall calls, providing said unavailable signal, but if all of the cars in the group have intervening hall calls, determining if any car in the group has no car calls beyond said specific call and if not, providing said available signal.

9. A method according to claim 8 additionally comprising:

determining if said given car is delayed; and providing said unavailable signal if said car is delayed unless all of the cars in the group are delayed.

10. A method according to claim 7 additionally comprising:

determining if said given car is delayed; and providing said unavailable signal if said car is delayed unless all of the cars in the group are delayed.

11. A method according to claim 7 wherein said hall calls are assigned to said cars by the steps of:

for each one of said cars that is a candidate to respond to an unassigned hall call, providing a signal indicative of a term in each one of a plurality of first sets of criteria signals, each of said first sets corresponding to a first hall call assignment criteria, each of said first sets corresponding to a different degree of said first assignment criteria, each term of said first sets having a value indicative of the extent to which the assignment of said one car to said call has the degree of conformance to said first assignment criteria indicated by the corresponding first set;

for each of said cars that is a candidate to respond to said hall call, providing a signal indicative of a term in each one of a plurality of second sets of criteria signals, each of said second sets corresponding to a second hall call assignment criteria, each of said second sets corresponding to a different degree of said second assignment criteria, each term of said second set having a value indicative of the extent to which the assignment of said one car to said call has the degree of conformance to said second assignment criteria indicated by the corresponding second set;

providing a predetermined set of emphasis signals, each emphasis signal corresponding to the combination of one of said first sets with one of said second sets;

providing a plurality of weighted signals, each weighted signal comprising the product of one of said preference signals and a term from each of said sets corresponding to said one preference signal;

providing, for each of said cars, the summation of said weighted signals; and dispatching said cars in said building in a process that includes assigning the one of said cars having the largest value of said summation signal to respond to said hall call.

* * * * *